United States Patent [19]

Smith

[11] Patent Number: 5,060,491

[45] Date of Patent: Oct. 29, 1991

[54] TUBULAR LOCK BOX

[76] Inventor: Neil E. Smith, #1006 7361 Halifax St., N. Burnaby, BC, Canada, V5C 5P8

[21] Appl. No.: 639,679

[22] Filed: Jan. 10, 1991

[51] Int. Cl.[5] ..... E05B 65/52

[52] U.S. Cl. ..... 70/63; 70/14; 70/58

[58] Field of Search ..... 70/63, 371, 14, 58, 70/19, 57

[56] References Cited

U.S. PATENT DOCUMENTS

| | | | |
|---|---|---|---|
| 3,744,281 | 7/1973 | Logue | 70/58 |
| 4,296,617 | 10/1981 | Campagna | 70/63 |
| 4,325,237 | 4/1982 | Menzie | 70/14 |
| 4,380,915 | 4/1983 | Kincaid | 70/371 |

*Primary Examiner*—Robert L. Wolfe
*Attorney, Agent, or Firm*—Hughes & Multer

[57] ABSTRACT

A lockable key box having a tubular receiver portion with an integrally formed mounting flange, and a closure plug which is lockably receivable in an open end of the receiver portion. The closure plug is formed of an inner sleeve which fits within the outer sleeve formed by the receiver, and a master key-operated cylindrical lock mechanism which is retained within the inner sleeve so that a locking plunger extends from the lock mechanism through a transverse bore in the inner sleeve to engage a locking recess in the outer sleeve. The locking plunger is outwardly-biased and has a bevelled leading face so that the closure plug can be inserted into the receiver portion without using the master key. The receiver portion has a substantially continuous transverse cross section, so that it can be formed of extruded material, such as high strength extruded aluminum alloy. The mounting flange can be attached directly to the exterior of a structure, or to a bracket which is configured for temporarily mounting the key box to a particular type of structure.

31 Claims, 4 Drawing Sheets

TUBULAR LOCK BOX

BACKGROUND OF THE INVENTION

1. Field of the Invention

The present invention relates generally to lockable receptacles, and more particularly, to a lockable receptacle for holding a key to a dwelling, or like structure, to which the lockable receptacle is attached.

2. Description of the Prior Art

Key boxes are frequently provided for holding the keys to a building, a motor vehicle, or a like structure to which the key box is attached. An authorized person, such as a fireman, realtor, car salesman, or mechanic is provided with a master key to open the key box so as to gain access to the keys to the structure.

Prior key boxes have exhibited a number of drawbacks. Firstly, these key boxes have typically taken the form of a box-like structure, which, for reasons of economy, is conventionally formed of cast "pot " metal, such as zinc alloy. Due to their relatively low strength and angular configuration, these pot metal key boxes are susceptible to penetration by a thief by means of hammering or prying. While it would be possible to strengthen such conventional box-like key boxes by forming the parts from steel, this Would be very expensive.

Another serious drawback of conventional key boxes is that they typically require the use of the master key to lock the box again. For example, in the key box disclosed in U.S. Pat. No. 4,296,617 (Campagna), a circular lock detent 74 is rotated between a locked and unlocked position by the master key to lock the key in this key box, it is necessary to replace the key within the box and then rotate the lock detent to the locked position using the master key. This is particularly disadvantageous if it is necessary to remove the key from Within the key box and give it to another person (e.g., a mechanic) for subsequent use: this key cannot be locked up again without either (a) calling the authorized holder of the master key to do this, which is a significant inconvenience, or (b) giving the master key to the other person (i.e., the mechanic), Which risks the possibility that the master key may be copied. Furthermore, it is simply inconvenient, even for the authorized holder of the master key, to retrieve the master key from his key ring or pocket to lock the key box again. Still further, these conventional key boxes typically contain an unattached key (e.g., see key 62 in Campaqna), and this is easily lost once it has been removed from the key box.

Another disadvantage of conventional key boxes is that they are frequently limited by their physical configuration to use with a single type of structure. For example, the cylindrical lock box of Campagna is configured to be installed in a bore formed through a door of a building, which arrangement is highly unsuitable for use with automobiles or the like. By way of another example, the key holder disclosed in U.S. Pat. No. 3,744,281 (Logue et al.) shows a key box mounted on What appears to be a sheet metal bracket which hooks over the top of a car window and extends downwardly between the window and the door, and this arrangement, in turn, would not be suitable for permanent attachment to the exterior of a building.

Accordingly, !here exists a need for a high strength, yet inexpensive, key box in Which the key may be replaced and locked Without requiring use of the master key. Furthermore, there is a need for such a key box which facilitates mounting on a wide variety o; structures, including buildings and motor vehicles.

SUMMARY OF THE INVENTION

The present invention has solved the problems cited above, and comprises generally a receiver portion formed of an elongated tubular member having a longitudinally extending cavity which is open through only one axial end, and mounting means formed integrally with the exterior of the tubular member for attachment of the receptacle to a structure, and a closure plug which is receivable within the open axial end of the tubular member so as to enclose a key within the longitudinal cavity. Locking means are mounted to the closure plug for locking the plug in the open end of the tubular member, the locking means having an engagement portion which is selectively movable, in response to operation of a master key, from a locked position, in which the engagement portion engages the tubular member to prevent withdrawal of the closure plug from the cavity, to an unlocked position, in Which the engagement portion disengages from the tubular member so as to permit withdrawal of the closure plug from the cavity. The locking means is configured to permit the closure plug to be inserted in the open end of the tubular member, so that the engagement portion lockingly engages the tubular member, without requiring operation of the master key.

The tubular member may comprise an outer sleeve, and the closure plug an inner sleeve for containing the locking means, the inner sleeve being configured to be slidingly received in the outer sleeve. The outer sleeve forms a cylindrical lonqitudinal cavity, and the inner sleeve may be cylindrical to be received therein. The lock mechanism, in turn, may be cylindrical, and the inner sleeve may be provided with a cylindrical lonqitudinal bore for receiving this. The engagement portion of the lock mechanism may be a locking plunger Which extends outwardly from the sleeve through a transverse bore therein.

The locking plunger of the lock mechanism may be a spring-loaded, outwardly biased plunger having an outer end Which is configured to react against the outer sleeve to depress the plunger so that the inner sleeve and lock mechanism can be inserted into the open end of the outer sleeve without use of the master key; the outer end of the locking plunger may have a beveled leading face Which reacts against the outer sleeve to depress the plunger. In the locked position, the plunger extends outwardly from the inner sleeve to engage the locking recess in the outer sleeve, and in the unlocked position the plunger is retracted to a position intermediate the diameters of the exterior and the longitudinal bore of the inner sleeve, so that the outer end of the plunger disengages from the locking recess, but so that a side of the plunger abuts the wall of the transverse bore In the inner sleeve so that the lock mechanism and inner sleeve can be withdrawn together from the cavity by exerting a longitudinal force on the lock mechanism alone, as by pulling on the master key.

The inner sleeve may have a plurality of transverse bores positioned at different selected longitudinal distances from the outer end of the sleeve so that a plurality of lock mechanisms having locking plungers at different longitudinal distances from their outer ends can be received in the inner sleeve, the locking plunger of each lock mechanism being positionable in a selected one of the transverse bores so that the outer end of the lock mechanism is flush with the outer end of the inner sleeve.

As noted above, the inner and outer sleeves may be cylindrical. The lock mechanism, in turn, may be responsive to manual rotation of a master key in engagement therewith, and engagement means may be provided for preventing rotation of the inner sleeve in the outer sleeve as the master key is rotated. The engagement means may comprise a first longitudinally extending flat formed in the wall of the longitudinal cavity, and a second longitudinally extending flat formed in the exterior of the inner sleeve and configured to slidingly abut the first longitudinally extending flat when the inner sleeve is received in the outer sleeve.

The integrally form®d mounting means may comprise a mounting flange which extends longitudinally along the exterior of the tubular member. The transverse cross section of the elongated tubular member and the integrally formed mounting flange may be generally continuous so that the tubular member and flange are formable of an extruded material, such as high strength extruded aluminum alloy.

Figure 7B:
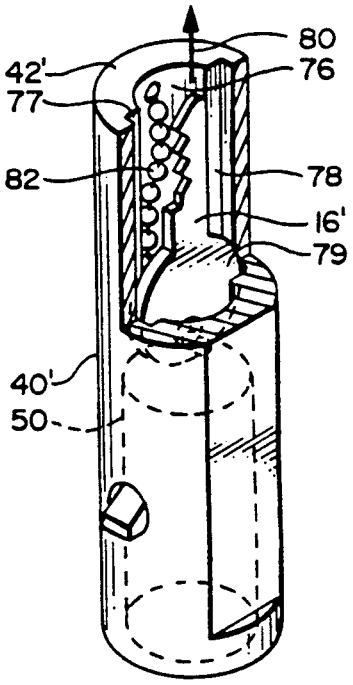
Figure 7A:
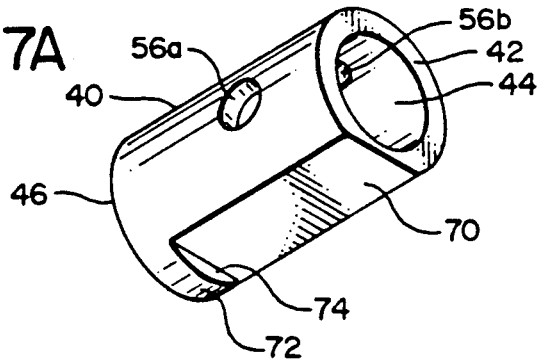
Figure 8:
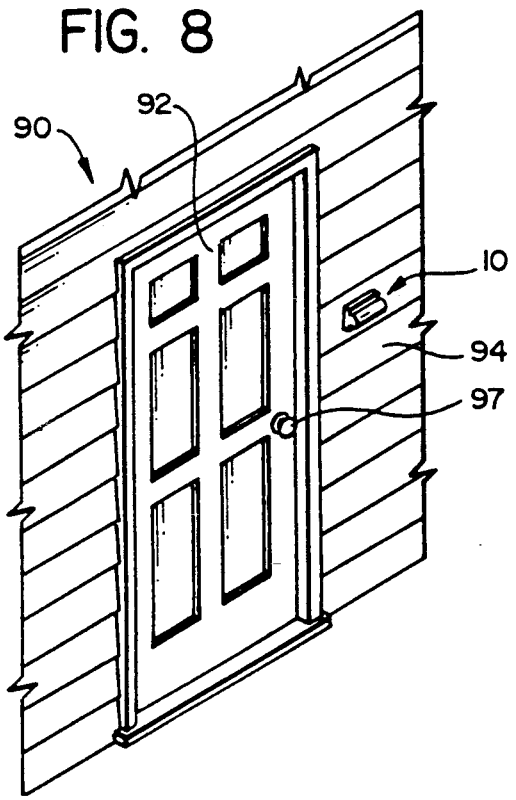
Figure 9:
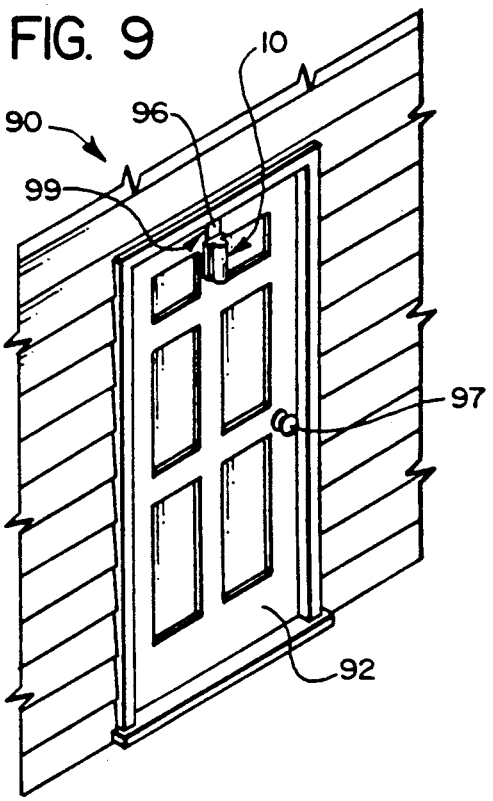
Figure 10:
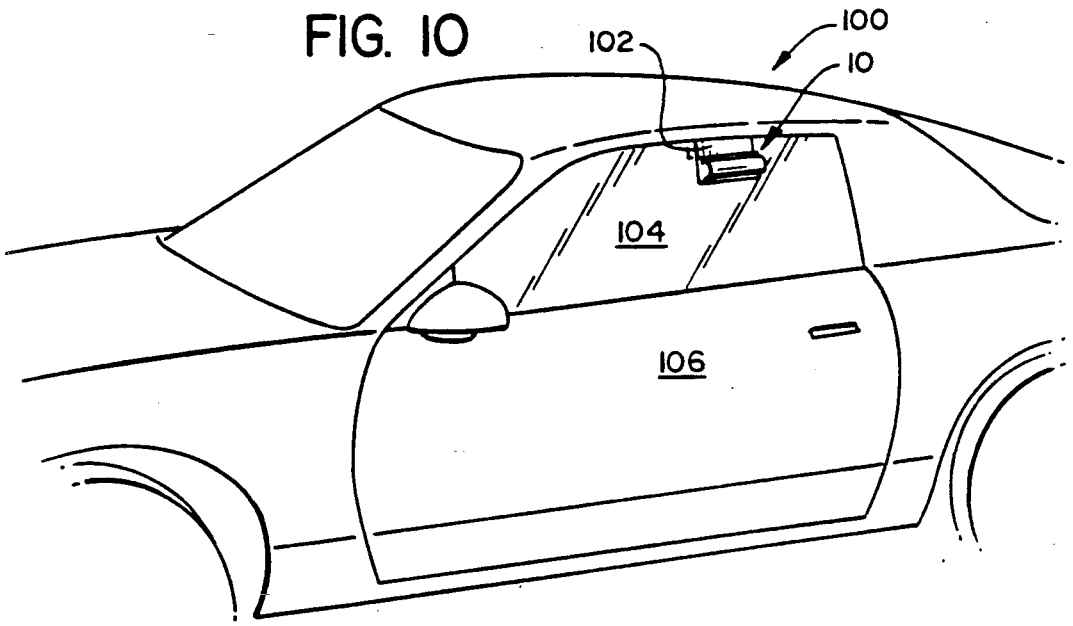

FIG. *7a* is a perspective view of the inner sleeve which contains the cylinder lock mechanism FIG. *7b* is a perspective view of another inner sleeve, this being configured to hold and partially enclose the key so as to facilitate its replacement in the outer sleeve;

FIG. 8 is a perspective view of a portion of a building having the key box of FIGS. 1-7 mounted thereto by means of bolts directly attached to a mounting flange which is formed integrally with the tubular outer sleeve;

FIG. 9 is a perspective view similar to that of FIG. 8, showing the key box mounted thereto by means of a bracket which is bolted to the mounting flange of the, key box and fits over the top edge of the door of the building; and FIG. 10 shows a perspective view of a portion of an automobile having the key box of FIGS. 1-7 mounted thereto by means of a bracket which fits over the top edge of the window of the automobile.

DESCRIPTION OF THE PREFERRED EMBODIMENTS

Figure 1:
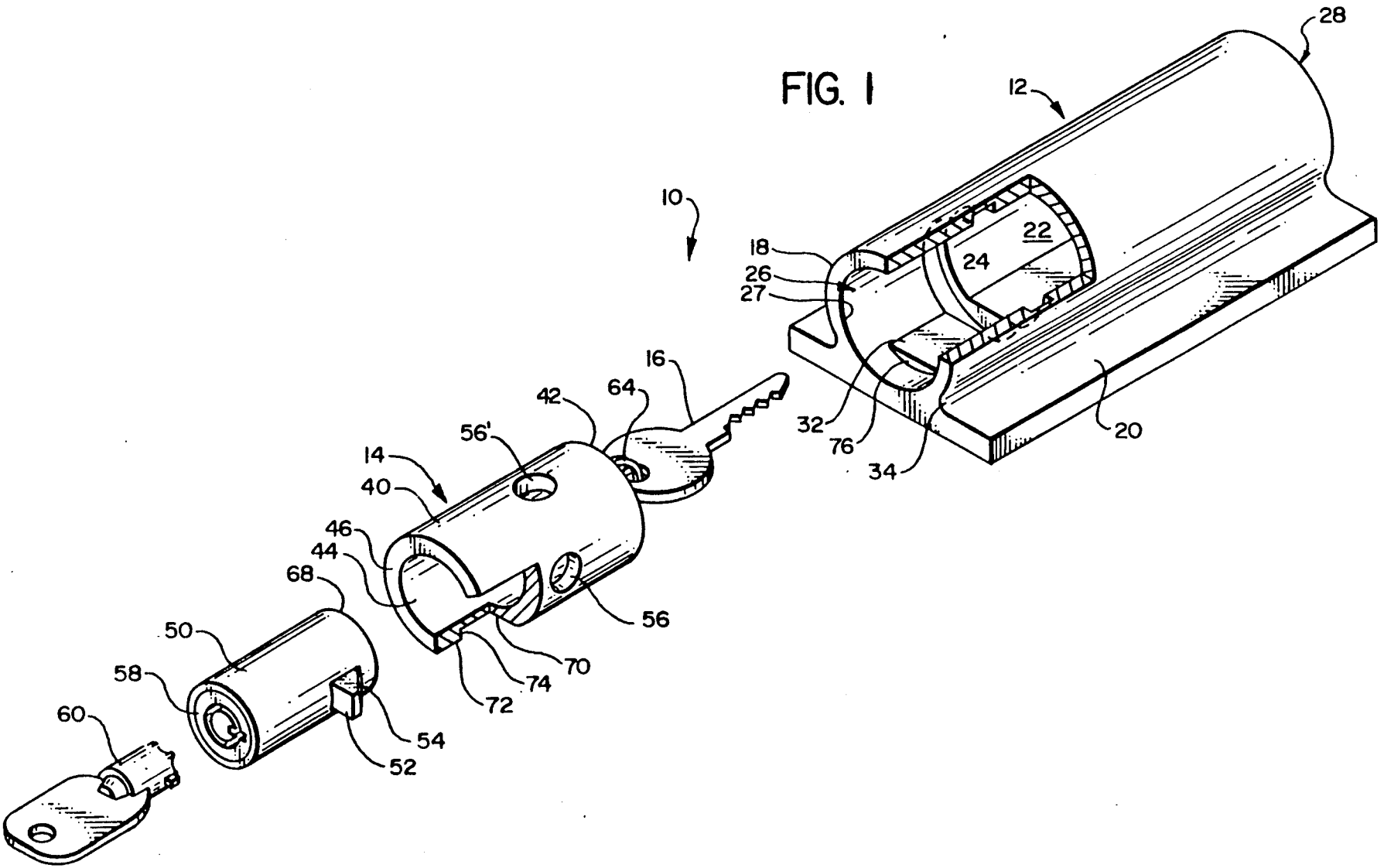
FIG. 1 is an exploded perspective view of a tubular key box incorporating the present invention.

FIG. 1 shows an exploded view of a tubular key box 10 according to the present invention. Key box 10 comprises generally a tubular receiver portion 12, and a cylindrical locking plug portion 14 which is received within receiver portion 12 so as to enclose a secondary key 16 therein. Tubular receiver portion 12 comprises generally a cylindrical outer sleeve 18 and a substantially planar mounting flange 20 which is formed integrally with cylindrical outer sleeve 18 so as to extend along a longitudinal edge thereof.

Outer sleeve 18 forms a generally cylindrical chamber 22 which is sized to receive secondary key 16. A 360° annular locking groove 24 is formed in the inner Wall of outer sleeve 18, and this serves as an engagement area for the locking mechanism of locking plug portion 14. The open mouth end 26 of the outer sleeve defines a circular opening 27, while the closed end 28 is sealed by a blank plug 30 (see FIG. 5}. A raised flat 32 (see FIG. 1) forms a planar, longitudinally extending abutment surface within sleeve 18, the purpose of which will become apparent from the following description, and the end of this is recessed from the mouth end of the sleeve to form the circular opening 27.

It Will be appreciated !rom the foregoing that, with the exception of the machined circular mouth opening 27 and locking groove 24, the tubular receiver portion has a continuous cross section throughout its length. This is important in that it permits the tubular receiver portion to be formed by means of a continuous extrusion through a die. Tubular receiver portion 12 can consequently be fabricated of inexpensive, but very high strength extruded aluminum alloy, which is much tougher than the zinc alloy castings which are typically employed by conventional key boxes. For example, key boxes in accordance with the present invention can be formed of extruded 6061-T6 high strength aluminum alloy. Furthermore, this permits mounting flange 20 to be formed integrally with the tubular outer sleeve 18, and the radiused joint 34 between these portions is strong and does not afford any purchase for a prying instrument. Still further, this facilitates the fabrication of a range of key boxes having internal chambers of various lengths, since the extruded aluminum can be cut at whatever length is desired.

Circular opening 27 at the mouth end of tubular receiver portion !2 is sized to receive a generally cylindrical) inner sleeve 40, this having secondary key 16 mounted at its inner end 42. An internal bore 44 extends from the outer end 46 of inner sleeve 40, and is sized to receive a cylinder lock mechanism 50. An example of cylindrical lock mechanism which is suitable for use in the key box of the present invention is a Gem Fop-out TM Model YPT-1010, available from Fort Lock Corporation, 3000 N. River Road, River Grove, Illinois 60171. It is conventional within the lock industry that such cylindrical lock mechanisms (which are commonly used on vending machines) have a standard external diameter of ¾ inch. Accordingly, the internal bore 44 of inner sleeve 40 is sized to have a diameter just slightly greater than ¾ inch so as to slidingly receive cylinder lock mechanism 50. An outwardly biased spring-loaded locking plunger 52 extends from lock mechanism 50 and is provided with a beveled leading face 54 at its outer end. A cylindrical transverse bore 56 in inner sleeve 40 accommodates the passage of spring-loaded locking plunger 52 therethrough; preferably, the inner sleeve is provided With a plurality of radially spaced-apart transverse bores 56 at various selected positions along its length. This arrangement of multiple transverse bores is highly advantageous in that, although conventional cylindrical lock mechanisms 50 have a standardized external diameter, the lonqitudinal distance between their outer ends 58 and their locking plungers 52 vary from model to model and manufacturer to manufacturer. Accordingly, the plurality of transverse bores 56 at various selected lengths along inner sleeve 40 permit these various models and makes of cylindrical lock mechanisms to be accommodated a single configuration of inner sleeve 40 with their locking plungers received in selected transverse bores 56, while in each case their outer faces 58 remain flush with the outer end 46 of sleeve 40. The annular configuration of locking groove 24 permits the locking plungers to engage it at the various radial positions of bores 56. Thus, a standard tubular key box 10 having a standard receiver Portion and standard inner sleeve 40 can be provided to locksmiths, who can, in turn, select a cylindrical lock mechanism 50 of their choice and install it therein. Cylindrical lock mechanism 50 is operated by a master key 60; as the master key is rotated from a locked position to an unlocked position, the spring-loaded plunger 52 is Withdrawn from locking groove 24 and so as to permit plug portion 14 to be withdrawn from tubular receiver portion 12.

Figure 2:
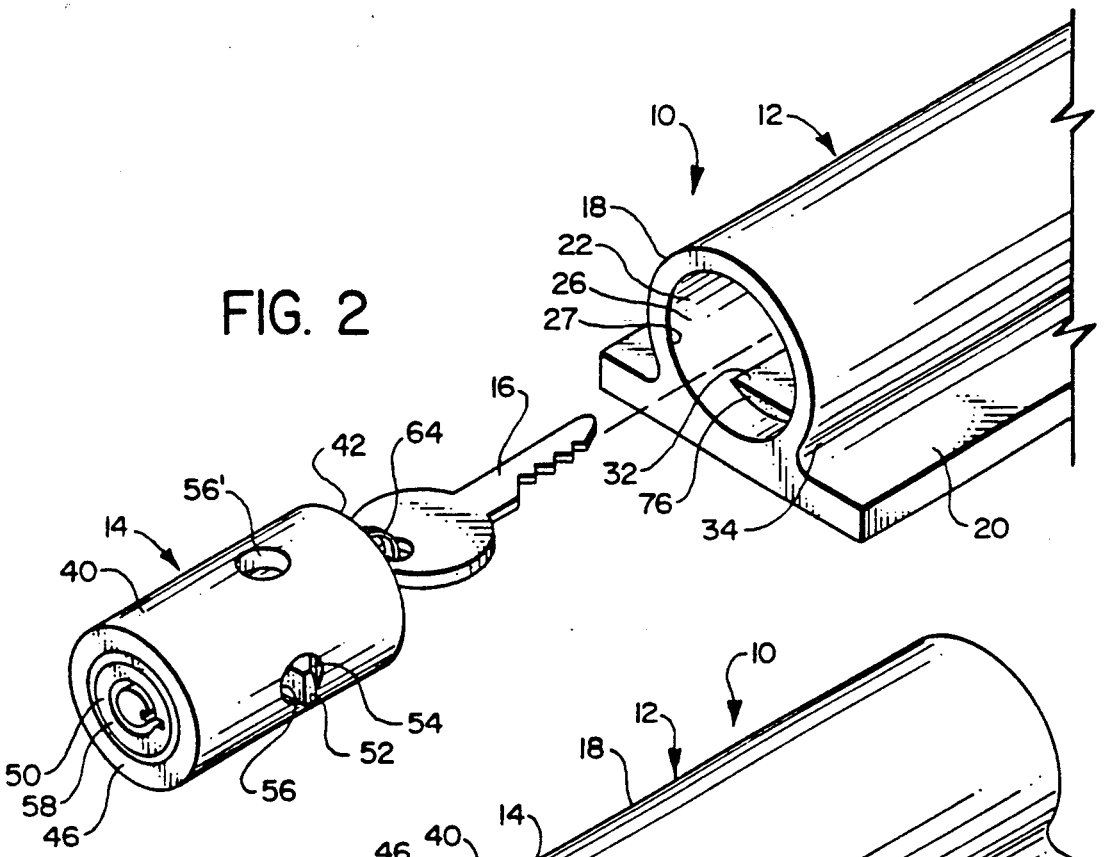
FIG. 2 is a perspective view of the key box of FIG. 1, showing the assembled locking plug to which the secondary key is attached, this assembly being positioned for reinstallation in the outer sleeve of the-key box.

FIG. 2 shows locking plug portion 14 fully assembled, with spring-loaded locking plunger 52 protruding outwardly through transverse bore 56. The thickness of sleeve 40 is such that the outer end of locking plunger 52 extends sufficiently far beyond the outer wall of the sleeve to engage annular locking groove 24 when in the locked position. When key 60 is rotated to the unlocked position, the outer end of plunger 52 is withdrawn within the outside diameter of inner sleeve 40 so as to permit the locking plug portion 14 to be withdrawn from receiver portion 12; however, the plunger is not withdrawn inwardly sufficiently far to permit the lock mechanism to be pulled out of the inner sleeve; to disengage lock mechanism 50 from sleeve 40, it is necessary to press inwardly on the outer end of plunger 52 with a suitable instrument, such as a pen, to depress plunger 52 within the diameter of internal bore 44 so that the lock mechanism can be withdrawn, this generally requiring use of the master key so as to provide a safeguard against copying of the lock cylinder.

Figure 4:
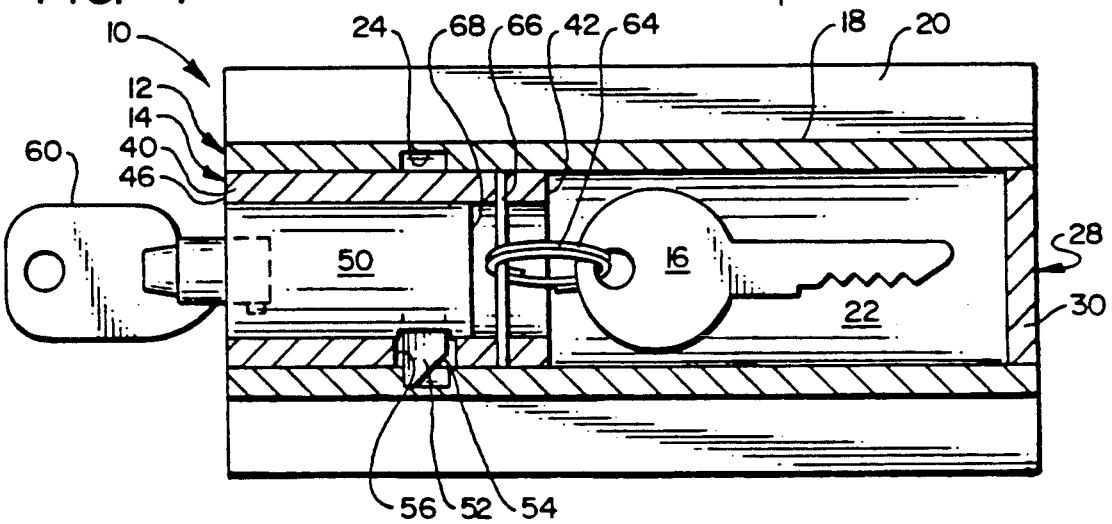
FIG. 4 is a top view of a cross-section taken along line 4—4 of FIG. 3, showing the master key in a locked position in which the plunger of the cylinder lock mechanism is in engagement with an annular locking groove in the outer sleeve.
Figure 5:
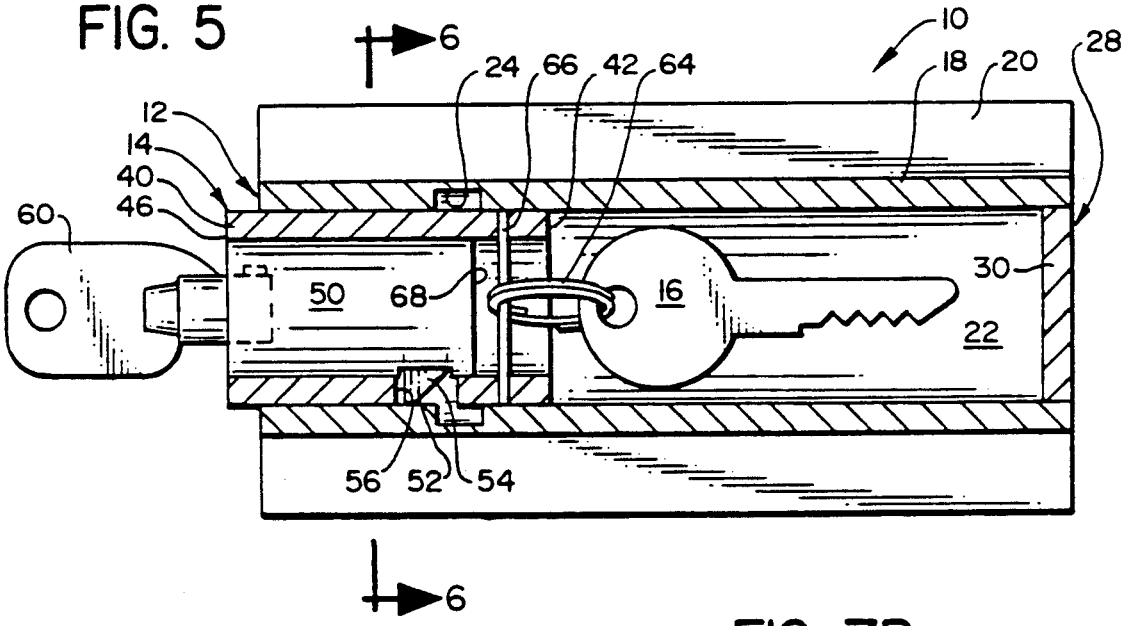
FIG. 5 is a top view of the cross-section of FIG. 4, showing the master key in an unlocked position in which the lock plunger has been withdrawn from the locking groove in the outer sleeve so that the locking plug and key can be withdrawn therefrom.

As noted above, outwardly-biased, spring-loaded plunger 52 is provided with a beveled leading face 54 at its outer end. This permits locking plug portion 14 to be inserted into receiver Portion 12 and locked therein without use of master key 60. Key 16 is first placed within chamber 22 and then inner sleeve 40 is inserted into the open mouth end 26 of outer sleeve 18. As this is done, the beveled leading face 54 of the plunger reacts against the lip of the mouth end of sleeve 18 to drive spring-loaded plunger 52 inwardly so that locking plug portion 14 can be pressed fully into the tubular outer sleeve until plunger 52 reaches annular locking groove 24 and moves outwardly into locking engagement therewith (as shown in FIG. 4), the non-beveled trailing face of the plunger preventing it from being subsequently withdrawn from the groove. When it is then desired to remove locking plug 14 so as to gain access to secondary key 16, the master key is inserted in the lock mechanism and rotated to withdraw locking plunger 52 inwardly out of engagement with locking groove 24, as shown in FIG. 5. After the locking plug and secondary key have been removed from the fixed receiver portion of the key box, the master key can be removed from the lock mechanism, and the secondary key !6 can be carried about and utilized as needed, locking plug portion 14 remaining attached thereto so as to serve as a convenient sized fob which helps to prevent misplacement or loss of the secondary key. When the operator has finished with secondary key 16, the secondary key and locking plug portion are simply pressed back into the tubular outer sleeve 18 without having to use the master key 60 again, thus avoiding the drawbacks of the conventional key boxes which have been described above.

Figure 3:
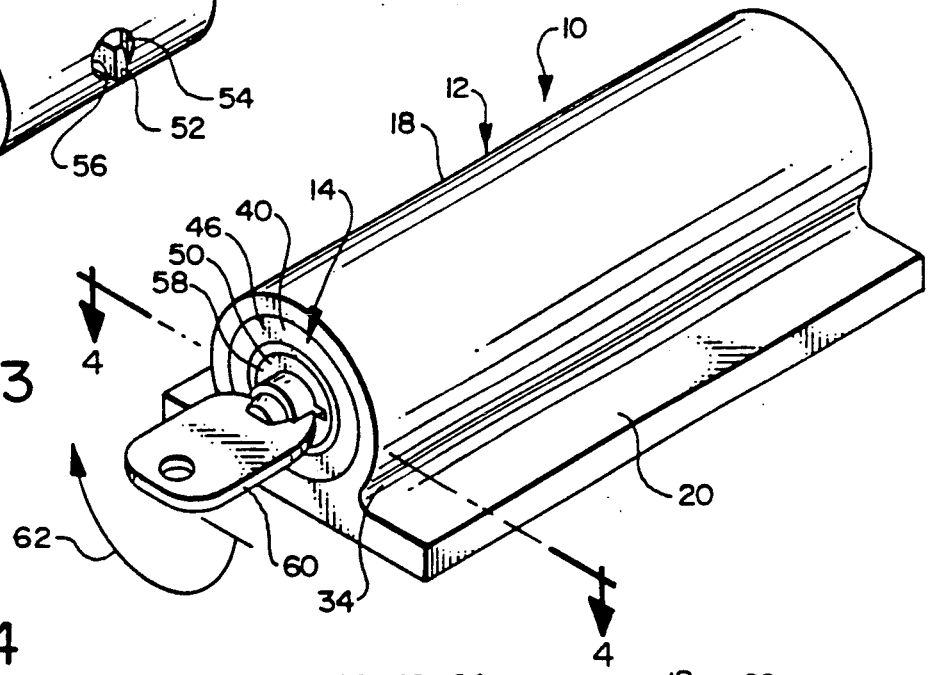
FIG. 3 is a perspective view of the key box of FIGS. 1-2, showing the master key inserted within the cylindrical lock mechanism of the locking plug;.

FIG. 3 shows that locking plug portion 14 is configured to be installed in tubular receiver portion 12 so that the outer end of the locking plug is flush with the mouth end of the receiver, thus eliminating any point on the locking plug portion Where a thief might be able to achieve a grip with Which to pull or pry the plug outwardly from the receiver. When removing the locking plug, the master key is rotated from a locked position to an unlocked position in the direction indicated by arrow 62. FIG. 4 shows key 60 is in the locked position, in which the locking plunger is biased into engagement with the annular locking groove 24. When key 60 is rotated to the unlocked position shown in FIG. 5, locking Plunger 52 is withdrawn from annular locking groove 24, but, as previously noted, does not withdraw fully within the internal bore 44 of inner sleeve 40, and locking plunger 52 consequently abuts the wall of transverse bore 56 so as to permit the operator to withdraw the lock mechanism and inner sleeve together by simply pulling on master key 60. As this is done, secondary key 16 is simultaneously withdrawn from cylindrical chamber 22, inasmuch as it is connected by a conventional split ring 64 to an attachment pin 66 which is mounted transversely across a portion of inner sleeve 40 Which extends beyond the inner end 68 of cylinder lock mechanism 50.

Figure 6:
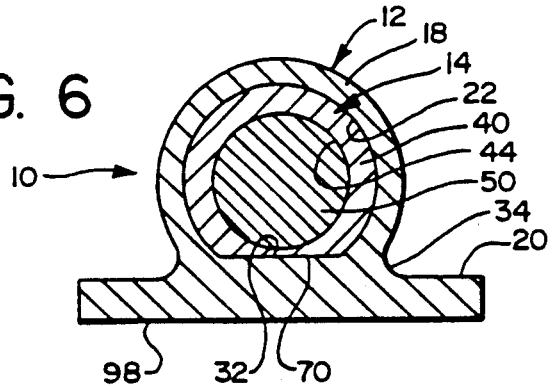
FIG. 6 shows an end view of a cross-section taken along line 6—6 of FIG. 5, showing the annular relationship of the outer sleeve, inner sleeve, and cylinder lock mechanism.

FIG. 6 shows the annular relationship between outer sleeve 18, inner sleeve 40, and cylindrical lock mechanism 50. FIG. 6 also particularly illustrates the continuous cross section of tubular receiver portion !2 which permits it to be formed of inexpensive high-strength extruded aluminum alloy. This cross-section includes the internal raised flat 32, which slidingly abuts a corresponding recessed flat 70 which extends longitudinally along the generally cylindrical outer wall of inner sleeve 40. The abutment of the flats 32 and 70 prevents the inner sleeve from rotating relative to the outer sleeve, so that the operator can turn the master key to operate lock mechanism 50. As is shown in FIG. 7A, recessed flat 70 extends most of the length of inner sleeve 40 from its inner end 42 towards its outer end 46, but stops short of outer end 46 so that a stopper lip 72 is formed Proximate the outer end of the sleeve. This stopper lip 72 Provides an inner shoulder 74 which abuts an outer shoulder 76 at the end of the raised flat in the outer sleeve, so as to prevent inner sleeve 40 and locking plug portion 14 from being pushed into outer sleeve 18 for forced entry.

In an exemplary key box incorporating the present invention, in which a conventional ¾ inch outside diameter cylindrical lock mechanism is employed, it has been found suitable to form an inner sleeve 40 of aluminum tubing having an approximately ¾ inch internal bore to accommodate the lock mechanism and an external diameter of approximately 1 1/16 inch, with the overall length of the inner sleeve being about $1\frac{3}{4}$ inch. The recessed flat 70 is cut approximately 1/16 inch into the wall of the inner sleeve, and terminates approximately $\frac{1}{4}$ inch from the outer end 46 of the sleeve to form stopper lip 72: According]y, the circular opening at open mouth end 26 extends approximately $\frac{1}{4}$ inch into sleeve 18 to accommodate the stopper lip. Outer sleeve 18 has an external diameter of approximately $1\frac{3}{8}$ inch and a bore of approximately 1 1/16 inch, with the raised flat extending about 1/16 inch into the bore, the other end of sleeve 18 being closed by a simple 1/4 inch thick pressed-in plug, this being formed with an external diameter a few thousands of an inch greater than the bore of the outer sleeve and of a slightly softer aluminum alloy. The annular locking groove is formed by a 360° cut, approximately $\frac{1}{4}$ inch Wide and 3/32 inch deep, in the inner wall of sleeve 18. This arrangement facilitates inexpensive manufacture of these components, inasmuch as the recessed flat on the inner sleeve can be formed by simply milling this piece over the required length, and the circular opening in the extruded outer sleeve can be formed by machining the mouth end round for a length corresponding to that of the stopper lip. Furthermore, the transverse bores 56, 56' are formed as round holes having a sufficient diameter to accommodate the square locking plunger 52, so that these can be formed by a simple drilling operation, and the annular locking groove can be formed by another simple machining operation. Accordingly, it Will be appreciated that this arrangement dispenses with the need for lugs or other structures Which might necessitate formation by casting, and permits assembly using a minimum of parts and only simple machining and milling operations. The outer sleeve and mounting flange can be cut to any suitable length; however, a mounting flange having a width of approximately $2\frac{1}{4}$ inches and a thickness of $\frac{1}{4}$ inch, combined with an overall length of $4\frac{3}{4}$ inches has been found to provide a particularly sturdy and conveniently sized arrangement having sufficient storage space for most keys.

FIG. 7B shows another inner sleeve 40', having a configuration generally similar to inner sleeve 40 shown in FIG. 7A, with the exception that the inner end 42' of the sleeve has been extended longitudinally so as to form a cylindrical chamber 76 which receives and partially encloses the secondary key 16'. A pair of diametrically opposite internal grooves 77 and 78 extend longitudinally along the inside wall of chamber 76, these being formed by a simple longitudinal saw cut. Grooves 77 and 78 are sized to receive and hold the edges of the handle portion 79 of key 16', and chamber 76 preferably has sufficient length that at least a substantial portion of the handle portion of the key is received therein. In use, the inner sleeve is withdrawn from the outer sleeve as previously described, and then the operator removes key 16' from grooves 77, 78 by pulling it outwardly in the direction indicated by arrow 80. Key 16' can then be used, and is retained to inner sleeve 40' by a chain 82 Which accommodates the movement of key 16' into and out of chamber 76. The arrangement shown in FIG. 7B assists the operator in replacing the secondary key in the tubular key box, since the key is held by the inner sleeve so that it will fit into the outer sleeve without having to first manually position the key within the key box before pressing the locking plug in behind it. This arrangement is particularly advantageous where the key box 10 is positioned in a relatively high location (as at the top of a door, where it may be difficult for a short person to reach it, or in a position selected to minimize access thereto by a thief), since the tubular receiver can be aligned in a vertical direction and the inner sleeve 40' and the key 16' held therein can be replaced in the outer sleeve as a unit by pressing them upwardly into the receiver portion with one hand. As a simpler alternative to the arrangement shown in FIG. 7B, chamber 76 may extend a sufficient distance to form a cylindrical cup for holding the shank portion of the key (vice the handle portion), the key 16' being in an inverted position relative to that shown in FIG. 7B.

The versatility of the key box 10 incorporating the present invention is significantly enhanced by the arrangement of the integral mounting flange 20. This mounting flange provides a convenient yet secure attachment fitting, not only for direct mounting of the key box to a structure, such as a building, but also for mounting to a suitably formed mounting bracket or other fitting Which is in turn attachable to a selected portion of a structure. For example, FIG. 8 shows tubular key box 10 mounted to the exterior of a building 90 adjacent to the entrance door 92 thereof. In this arrangement, the mounting flange 20 directly abuts the external surface of the wall 94 of the building, and is securely fixed thereto by means of bolts (not shown) which extend through wall 94 from the interior of the building and into threaded bores (not shown) which are provided in the back side of the mounting flange 20. The arrangement shown in FIG. 8 is particularly suitable for use in a permanent installation, such as might be required by a fire department for commercial buildings in a business park or the like, where the key box contains the keys to the particular building 90 and the fire department holds the master key to the key box. A similar mounting arrangement may be suitable for use with utility vehicles, such as earth moving equipment, utility trucks, and the like, where the flange 20 of the key box may be permanently bolted to some suitable portion of the vehicle, such as a bumper and the master key may be held by a foreman or a security officer.

FIG. 9 shows an arrangement in Which the tubular key box 10 is detachably mounted to buildinq 90 by means of a U-shaped mounting bracket 96 Which extends over the top edge of door 92 so as to be held firmly in place when the door is closed and locked by locking door knob 97. This arrangement is eminently suitable for use by realtors, where the key box is temporarily mounted to a house which is to be shown, the realtors gaining access to the key to door knob 97 by means of the master key to key box 10. The broad, flat rear face 98 (see FIG. 6) of mounting flange 20 provides a convenient yet secure attachment point for the mounting bracket, the heads of the bolts, rivets, or the like at rear face 98 being inaccessible when the key box is attached to the locked door as shown. Mounting bracket 96 is configured to position key box 10 sufficiently far below the top of door 92 that a gap 99 is formed which accommodates the molding of the door when in the closed position.

FIG. 10 shows a mounting arrangement somewhat similar to that shown in FIG. 9, in which the key box 10 is temporarily mounted to an automobile 100 by means of another U-shaped mounting bracket 102 which is attached to the rear face of flange 20, bracket 102 being configured in this case to fit over the edge of the door window 104 of the automobile When the window is rolled up and the door 106 is closed and locked. This arrangement is particularly suitable for use by automobile dealers, rental companies, and the like, where a salesman or the like may use the master key to gain access to keys of the automobile which are contained in the key box. Accordingly, it will be appreciated that integral mounting flange 20 provides a single configuration of tubular key box 10 With the adaptability to be mounted to a wide variety of structures.

A key box having cylindrical outer and inner sleeves as previously described has been found to be a particularly effective and economical arrangement; however, it should be recognized that it may be found desirable in some circumstances to form these tubular components with corresponding oval, square, or polygonal cross-sections Having described my invention, many modifications thereto will become obvious to those skilled in the art to Which it pertains without deviation from the spirit of the invention as defined by the scope of the appended claims.

What is claimed and desired to be secured by Letters Patent of the United States is:

1. A lockable receptacle for a key, said receptacle comprising:

an elongated tubular member having a longitudinally extending cavity Which is open through only one axial end of said member;

mounting means formed integrally with the exterior of said tubular member for attachment of said receptacle to a structure;

a closure plug which is receivable within said open axial end of said tubular member so as to enclose said key within said longitudinal cavity; and locking means mounted to said closure plug, said locking means having an engagement portion Which is selectively movable in response to operation of a master key from a locked position, in which said engagement portion engages said tubular member so as to prevent withdrawal of said closure plug from said cavity, to an unlocked position, in which said engagement portion disengages from said tubular member so as to permit withdrawal of said closure plug from said cavity, said locking means being configured to permit said closure plug to be inserted in said open end of said tubular member, so that said engagement Portion lockingly engages said tubular member, without requiring said operation of said master key.

2. The lockable receptacle of claim 1, wherein said tubular member comprises an outer sleeve, and said closure Plug comprises an inner sleeve for containing said locking means, said inner sleeve being configured to be slidingly received in said outer sleeve.

3. The lockable receptacle of claim 2, wherein said engagement portion of said locking means comprises an outwardly biased locking plunger which extends outwardly from said inner sleeve in said locked position so as to engage a locking recess in said cavity in said outer sleeve.

4. The lockable receptacle of claim 3, wherein said outwardly biased locking plunger has an outer end Which is configured to react against said outer sleeve so as to depress said locking plunger sufficiently far inwardly to permit said inner sleeve to be slidingly received in said outer sleeve as said closure plug is inserted in said open end of said outer sleeve.

5. The lockable receptacle of claim 4, wherein said outer end of locking plunger has a bevelled leading face which reacts against said outer sleeve so as to depress said plunger as said closure plug is inserted in said open end of said outer sleeve.

6. The lockable receptacle of claim 3, wherein said outer sleeve is a generally cylindrical sleeve having a generally cylindrical cavity therein, and said inner sleeve has a generally cylindrical exterior which is configured to be slidingly received in said cylindrical cavity.

7. The lockable receptacle of claim 6, wherein said locking means is cylindrical lock mechanism, and said inner sleeve is provided with a longitudinally extending cylindrical bore !or receiving said lock mechanism.

8. The lockable receptacle of claim 7, wherein said locking plunger extends outwardly from said lock mechanism through a transverse bore in said inner sleeve, said lock mechanism being configured so that in said locked position the outer end of said plunger extends outwardly beyond said exterior of said inner sleeve so as to engage said locking recess in said outer sleeve, and in said unlocked position said outer end of said plunger is retracted to a position intermediate the diameters of said exterior and said longitudinal bore of said inner sleeve, so that said outer end of said plunger disengages from said locking recess in said outer sleeve and a side of said plunger abuts a wall of said transverse bore in said inner sleeve so that said lock mechanism and said inner sleeve can be withdrawn together from said cavity by exerting a longitudinal force on said lock mechanism alone.

9. The lockable receptacle of claim 8, wherein said inner sleeve has a plurality of said transverse bores, said transverse bores being positioned at different selected longitudinal distances from an axial outer end of said inner sleeve so that a Plurality of said cylindrical lock mechanisms having locking plungers positioned at predetermined different longitudinal distances from axial outer ends of said lock mechanisms can be received in said inner sleeve, said locking plunger of each said lock mechanism being positionable in a selected one of said transverse bores so that said axial outer end of said lock mechanism is substantially flush with said axial outer end of said inner sleeve.

10. The lockable receptacle of claim 6, wherein said engagement portion of said lock mechanism is selectively movable in response to manual rotation of said master key in engagement with said lock mechanism.

11. The lockable receptacle of claim 10, further comprising engagement means for preventing rotation of said inner sleeve in said cavity relative to said outer sleeve as said master key is rotated in engagement with said lock mechanism.

12. The lockable receptacle of claim 11, wherein said engagement means comprises:

a first longitudinally extending flat formed in the wall of said longitudinal cavity; and a second longitudinally extending flat formed in said exterior of said inner sleeve and configured to sliding1y abut said first longitudinally extending flat when said inner sleeve is received in said outer sleeve.

13. The lockable receptacle of claim 9, wherein said plurality of transverse bores in said inner sleeve are spaced apart radially and said lockable receptacle further comprises engagement means for preventing rotation of said inner sleeve relative to said outer sleeve as said master key is rotated in engagement with said lock mechanism, and said locking recess in said outer sleeve comprises an annular groove for receiving said locking plungers of said plurality of lock mechanisms which extend through said radially spaced apart transverse bores.

14. The lockable receptacle of claim 1, wherein said mounting means comprises a mounting flange which extends longitudinally along said exterior of said tubular member.

15. The lockable receptacle of claim 14, wherein the transverse cross-section of said elongated tubular member and integrally formed mounting flange is generally continuous so that said tubular member and flange are formable of an extruded material.

16. The lockable receptacle of claim 15, wherein said extruded material is high-strength extruded aluminum alloy.

17. A lockable receptacle for a secondary key, said receptacle comprising, a receiver portion having an elongated tubular outer sleeve forming a longitudinally extending cavity, and a longitudinally extending mounting flange formed integrally with a wall of said tubular outer sleeve, said receiver portion being formed of an extruded material having a substantially continuous transverse cross section, a first axial end of said tubular member being open and the second end of said tubular member being closed by a fixedly mounted plug;

an inner sleeve configured to be slidingly received in said open end of said outer sleeve, said inner sleeve having a cylindrical longitudinal bore and at least one transverse bore;

a cylindrical lock mechanism contained in said longitudinal bore in said inner sleeve and having a locking plunger positioned in said transverse bore, said locking Plunger being selectively movable, in response to operation of a master key in engagement, With said lock mechanism, from a locked position, in which the outer end of said locking plunger extends outwardly beyond said inner sleeve to engage a locking recess in the wall of said longitudinally extending cavity so as &o lock said lock mechanism and said inner sleeve in said outer sleeve so as to enclose said secondary key in said cavity, to an unlocked position, in which said outer end of said locking plunger is withdrawn to a position intermediate the exterior and inner diameter of said inner sleeve so that said lock mechanism and said inner sleeve can be withdrawn as a unit from said outer sleeve, so as to gain access to said secondary key, by exerting longitudinal force on said lock mechanism alone.

18. The lockable receptacle of claim 17, wherein said mounting flange is a substantially planar mounting flange.

19. The lockable receptacle of claim 18, further comprising a mounting bracket attached to said planar mounting flange, said mounting bracket being configured for temporary mounting of said lockable receptacle to a structure.

20. The lockable receptacle of claim 17, further comprising, a first longitudinally extending flat formed in said wall of said longitudinally extending cavity; and a second longitudinally extending flat formed in said exterior of said inner sleeve, said second flat being configured to slidingly abut said first longitudinally extending flat so as to Prevent said inner sleeve from rotating in said outer sleeve when said master key is rotated in engagement with said lock mechanism.

21. The lockable receptacle of claim 17, further comprising means for retaining said secondary key to said inner sleeve so that said lock mechanism and inner sleeve which are withdrawn as a unit from said outer sleeve provide a fob for preventing misplacement of said secondary key.

22. The lockable receptacle of claim 17, further comprising means for holding said secondary key in said inner sleeve so as to align said secondary key for replacement in said longitudinally extending cavity in said outer sleeve.

23. The lockable receptacle of claim 22, wherein said holding means comprises first and second longitudinal holding grooves in the wall of said longitudinally extending bore proximate an inner axial end of said inner sleeve, said holding grooves being configured to sliding1y receive the edges of a handle portion of a said secondary key so that said secondary key is held in substantially longitudinal alignment with said inner sleeve.

24. The lockable receptacle of claim 20, wherein said inner sleeve has a plurality of said transverse bores, said transverse bores being positioned at different selected longitudinal distances from an axial outer end of said inner sleeve so that a plurality of said cylindrical lock mechanisms having locking plungers positioned at predetermined different longitudinal distances from axial outer ends of said lock mechanism can be received in said inner sleeve, said locking plunger of each said lock mechanisms being positionable in a selected one of said transverse bores so that said axial outer end of said lock mechanism is substantially flush with said axial outer end of said inner sleeve.

25. The lockable receptacle of claim 24, wherein said plurality of transverse bores in said inner sleeve are spaced apart radially, and said locking recess in said outer sleeve comprises an annular groove for receiving said locking plungers of said plurality of lock mechanisms which extend through said radially spaced apart transverse bores.

26. A lockable receptacle for a key, said receptacle comprising:

an enclosure member having an interior cavity for holding said key, and an opening leading into said cavity;

a closure plug which is receivable within said opening so as to enclose said key within said cavity; and locking means mounted to said closure plug, said locking means having a spring-loaded locking plunger which is selectively movable in response to operation of a master key from an extended position, in which said locking plunger engages an engagement portion of said enclosure member so as to prevent withdrawal of said closure plug from said opening, to a retracted position, in which said locking plunger disengages from said engagement portion of said enclosure member so as to permit withdrawal of said closure plug from said opening;

said spring-loaded plunger having an outer end configured to react with said opening in said enclosure member to depress said plunger toward said retracted position as said closure member is inserted into said opening, so as to permit said closure plug to be inserted into said opening so that said locking plunger lockingly engages said enclosure member without requiring said operation of said master key.

27. The lockable receptacle of claim 26, wherein a leading edge of said outer end of said spring-loaded plunger is bevelled to react against the edge of said opening so that said spring-loaded plunger is depressed toward said retracted position as said closure plug is inserted into said opening, and said outer end of said plunger is spring-biased outwardly into engagement with said engagement portion of said enclosure member upon completion of insertion of said closure member into said opening.

28. The lockable receptacle of claim 27, wherein said engagement portion of said enclosure member is a recess in the inner wall of said opening for receiving said outer end of said plunger.

29. The lockable receptacle of claim 26, wherein said enclosure member is a longitudinally extending tubular member, and aid opening is an open axial end of said tubular member.

30. The lockable receptacle of claim 29, further comprising mounting means formed integrally with the exterior of said tubular member for attachment of said tubular member to a structure.

31. A lockable receptacle for a key, said receptacle comprising:

a receiver having a tubular outer sleeve forming a generally cylindrical cavity having an open end and a closed end, and a mounting flange formed integrally with the outer wall of aid sleeve, said sleeve having a raised, longitudinally extending flat formed on the inner wall thereon and first and second annular grooves in said inner wall, said first groove being continuous with said open end of said cavity so that an outer end of said flat forms a shoulder which is recessed from said open end of said cavity, and said second groove being spaced inwardly from said open end of said cavity;

a. cylindrical lock mechanism having a radially extending, spring-loaded locking plunger, the outer end of said locking plunger having a bevelled leading face, said lock mechanism being operative in response to rotation of a master key in engagement with said mechanism to withdraw said locking plunger from an extended position to a retracted position; and an inner sleeve for closing said open end of said cavity, said inner sleeve having a longitudinal bore for receiving said lock mechanism, and a radial bore for receiving said locking plunger of said lock mechanism which is in said longitudinal bore;

said inner sleeve having a generally cylindrical outer wall with an outer diameter sized so as to permit said inner sleeve to be slidingly received within said open end of said cavity, and so that said outer end of said plunger in said radial bore extends outwardly from said inner sleeve when in said extended position, said bevelled outer end of said plunger being configured to react against said open end of said cavity as said inner sleeve is inserted therein so as to depress said outer end of said plunger within said outer diameter of said inner sleeve, said outer diameter of said inner sleeve further being sized so that said outer end of said plunger is retracted within said outer diameter when in said retracted position, so as to permit said inner sleeve and lock mechanism to be withdrawn from said opening;

said outer wall of said inner sleeve having a recessed flat formed thereon for abutting said raised flat in said cavity so as to prevent said inner sleeve from rotating relative to said outer sleeve due to said rotation of said master key in said lock mechanism in said inner sleeve;

said recessed flat on said inner sleeve extending longitudinally from the inner end of said inner sleeve and terminating a spaced distance from the outer end of said inner sleeve so as to form a radially extending shoulder at a spaced distance from said outer end of said inner sleeve, said shoulder on said inner sleeve being configured to abut said shoulder in said outer sleeve so as to prevent insertion of aid inner sleeve into said cavity beyond a maximum limit, said radial bore in said inner sleeve being positioned so that when said inner sleeve is at said limit said locking plunger extends outwardly from said inner sleeve in said extended position and engages said second annular groove in said outer sleeve so as to prevent withdrawal of said inner sleeve and lock mechanism from said outer sleeve.

* * * * *